United States Patent [19]

Norton

[11] 4,095,713

[45] Jun. 20, 1978

[54] TAMPER RESISTANT CAP FOR QUICK-DISCONNECT COUPLING PLUG

[75] Inventor: James F. Norton, Berea, Ohio

[73] Assignee: The Coca-Cola Company, Atlanta, Ga.

[21] Appl. No.: 813,797

[22] Filed: Jul. 8, 1977

[51] Int. Cl.[2] ..... B65D 41/32

[52] U.S. Cl. ..... 220/270; 220/85 P; 220/257; 222/182; 137/377; 137/382

[58] Field of Search ..... 220/257, 266, 268, 270, 220/85 P; 215/251; 222/182, 153, 541; 137/377, 381, 382, 384, 797

[56] References Cited

U.S. PATENT DOCUMENTS

| | | | |
|---|---|---|---|
| 2,760,671 | 8/1956 | Parish, Jr. | 220/257 |
| 3,592,351 | 7/1971 | Johnson, Jr. | 220/257 |

*Primary Examiner*—George T. Hall

[57] ABSTRACT

A tamper resistant cap is used in association with the plug of a quick-disconnect coupling to indicate when a socket may have been connected with the plug. The tamper resistant cap includes a frangible sidewall which surrounds the plug to prevent connection of a socket with the plug. The cap lockingly engages a seal ring groove in the plug to hold the cap in place on the plug. The only way in which the cap can be removed from the plug is by breaking the sidewall of the cap. Once the sidewall of the cap has been broken, there is a clear indication that a socket may have been connected with the plug. To promote breaking of the cap, a plurality of axially extending sections of reduced cross sectional area are formed in the sidewall of the cap. The cap is advantageously provided with an end wall which overlies the outer end face of the plug to block exposure of the plug end face to dust, dirt and other foreign particles.

24 Claims, 11 Drawing Figures

TAMPER RESISTANT CAP FOR QUICK-DISCONNECT COUPLING PLUG

BACKGROUND OF THE INVENTION

This invention relates generally to an apparatus for indicating when the socket of a quick-disconnect coupling may have been connected with a plug and more specifically to an indicating member which is connected with the plug and must be broken before a socket can be connected with the plug.

Various types of seals have commonly been utilized in association with meters and containers to indicate when they have been opened. A locking seal which is utilized in association with luggage tags is disclosed in U.S. Pat. No. 2,511,751. This locking seal includes a plurality of internal prongs which are enclosed by a cover and engage an annular shoulder on a male member to interconnect portions of a luggage tag. The internal prongs are formed separately from the cover which is of a relatively strong construction and would not be readily broken by tampering with the seal.

A sealing cap having internal prongs to engage an annular groove at one end of a bolt is disclosed in U.S. Pat. No. 2,103,743. The cap has a cover formed of frangible material. A separate spider having retaining fingers is mounted inside the cap to engage the annular groove in the outer end of the bolt. Other known sealing arrangements are disclosed in U.S. Pat. Nos. 1,581,901; 1,582,444; and 3,709,261.

SUMMARY OF THE PRESENT INVENTION

The present invention provides a tamper resistant cap which is used in association with the plug of a quick-disconnect coupling. The cap cannot be removed from the plug without breaking the cap. Once the cap has been broken, there is a clear indication that a socket may have been connected with the plug.

The tamper resistant cap is of a one-piece construction and has inwardly projecting lock tabs or sections which engage an annular seal ring groove on the plug to hold the cap in position. When the cap is to be removed from the plug, the cap is broken along axially extending grooves formed in a side wall of the cap. An end wall is provided on the cap to cover the end of the plug.

Although it is contemplated that the tamper resistant cap of the present invention can be utilized in association with quick-disconnect coupling plugs in many different environments, the cap is advantageously utilized in association with plugs mounted on containers of liquid, such as soft drink syrup. When the containers have been filled at a suitable location, a tamper resistant cap is positioned over the plug. Until the cap has been removed, a socket cannot be connected with the plug to effect removal of the soft drink syrup from the container. As long as the cap remains unbroken there is a clear indication that a socket has not been connected with the plug to effect the removal of soft drink syrup from the container.

Accordingly, it is an object of this invention to provide a new and improved tamper resistant cap which is utilized in association with the plug of a quick-disconnect coupling to provide a clear indication that a socket has not been connected with the plug.

Another object of this invention is to provide a new and improved apparatus which includes a container having a quick-disconnect coupling plug with a seal ring groove adjacent to its outer end and an indicating member which lockingly engages the seal ring groove to hold the indicating member in place until the indicating member has been broken.

Another object of this invention is to provide a new and improved one piece indicating member which is removable from a plug of a quick-disconnect coupling only by breaking the indicating member to provide a clear indication that a socket may have been connected with the plug and wherein the indicating member includes a frangible wall which circumscribes the plug and has a portion of a reduced cross sectional area to promote breakage of the wall under the influence of forces tending to disengage the frangible wall from the plug.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
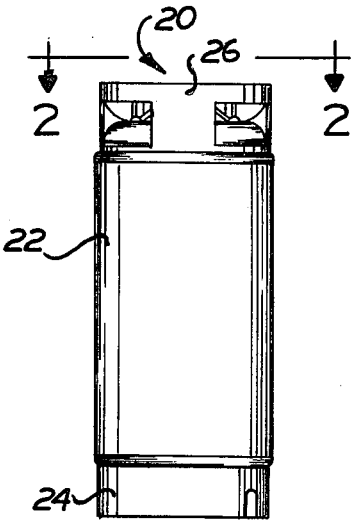
FIG. 1 is an elevational view of a container for holding fluid, such as soft drink syrup.
Figure 2:
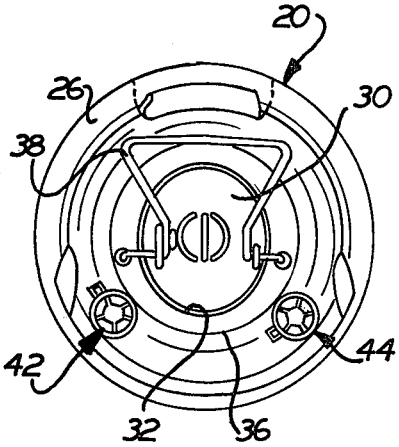
FIG. 2 is a plan view, taken generally along the line 2—2 of FIG. 1, illustrating the relationship between the container and a pair of tamper resistant caps disposed over plugs of quick-disconnect couplings.

A container 20 for holding fluids, such as soft drink syrups, is illustrated in FIG. 1. The container 20 has a cylindrical sidewall 22 which extends between a base 24 and a handle section 26 at the top of the container. The handle section 26 extends around a cover 30 (FIG. 2)

which blocks an opening 32 formed in an end wall 36 of the container 20. A handle 38 cooperates with the cover 30 and container end wall 26 to hold the cover closed in a manner similar to that disclosed in U.S. Pat. Nos. 3,186,577 and 3,244,316.

In accordance with a feature of the present invention, identical tamper resistant caps 42 and 44 are disposed over a pair of quick-disconnect coupling plugs 46 (FIG. 4) which are connected with the container end wall 36. When the one-piece cap 42 is disposed in telescopic engagement with the plug 46 in the manner shown in FIG. 4, a frangible sidewall 50 of the cap prevents engagement of a quick-disconnect coupling socket with the plug. The cap 42 can be removed from the plug 46 only by breaking the sidewall 50. Therefore as long as the cap is unbroken and in place over the plug 46, a clear indication is provided that a socket has not been connected with the plug 46 to effect the removal of fluid from the container 20. Conversely, if the tamper resistant cap 42 has been broken, there is a clear indication that the socket of a quick-disconnect coupling may have been connected with the plug to remove fluid from the container.

The sidewall 50 of the tamper resistant cap 42 includes a cylindrical base 54 (see FIGS. 3, 4 and 6) which circumscribes the plug 46. The base 54 blocks access to radially outwardly extending connector pins 56 and 58 on a metallic plug body 60 which is fixedly connected at an inner end portion 62 to the container end wall 36 (see FIG. 4). Since the base section 54 of the tamper resistant cap 42 blocks access to the connector pins 56 and 58, a socket cannot be connected with the plug 46 in the manner described in U.S. Pat. No. 3,896,977.

A plurality of lock tabs or sections 62, 64, 66, 68 and 70 are integrally formed with the base 54 and extend axially upwardly from the base. The lock tabs 62–70 engage an annular seal ring groove 74 (FIG. 4) formed in the plug body 60 to hold the tamper resistant cap in place on the plug body. The distance between an annular end face 78 of the plug body and an upper side surface 80 of the seal ring groove 74 is equal to or slightly less than the distance between the lower side surface 82 of an end wall 84 of the tamper resistant cap and retaining surfaces 86 formed on the upper end of each of the locking tabs 62–70 (see FIGS. 3–6).

The retaining surfaces 86 on the lock tabs 62–70 abuttingly engage the upper side surface 80 of the annular O-ring groove 74. Therefore, the cap 42 cannot be pulled axially outwardly away from the container end wall 36 to expose the connector pins 56 and 58. The inner surface 82 of the end wall 84 abuttingly engages the end face 78 of the plug body 60. Therefore, the tamper resistant cap 42 cannot be moved axially inwardly from the position shown in FIG. 4. The cooperation between the lock tabs 62-70 and the annular seal ring groove 74 is such to hold the cap 42 securely in position on the plug body 60.

Figure 3:
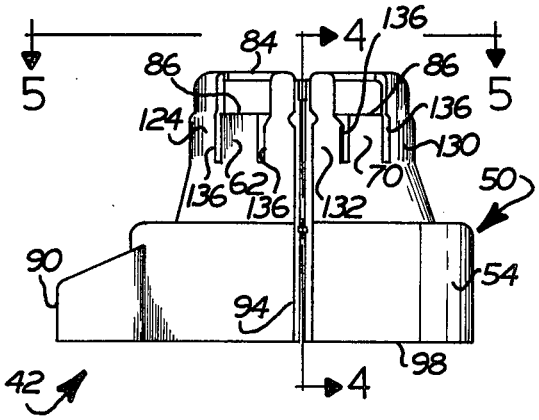
FIG. 3 is an enlarged elevational view of one of the tamper resistant caps.

The only way in which the cap 42 can be removed from the plug 46 is by breaking the cap. To promote breakage of the cap whenever forces are applied to a handle 90 which is integrally formed with and projects outwardly from the base section 54, a pair of axially extending grooves or sections of reduced cross sectional area 94 and 96 are formed in diametrically opposite portions of the sidewall 50. The groove 94 extends upwardly from a circular end surface 98 of the base section 54 to the generally circular end wall 84 (FIGS. 3 and 5). The groove 96 extends upwardly from the circular end surface of the base section 54 into the lock tab 66 (see FIGS. 4, 5 and 6).

Figure 5:
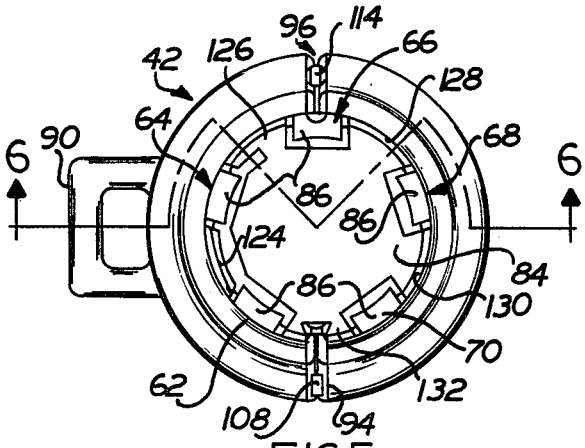
FIG. 5 is a top plan view, taken generally along the line 5—5 of FIG. 3, further illustrating the construction of the tamper resistant cap.
Figure 6:
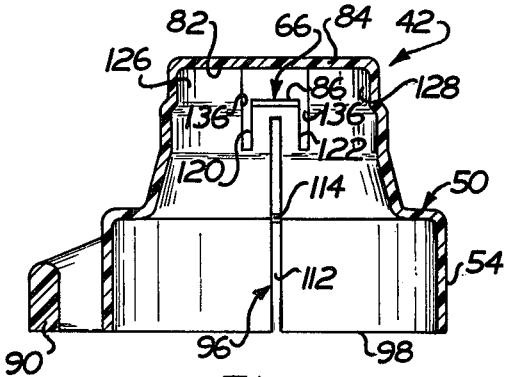
FIG. 6 is a sectional view, taken along the line 6—6 of FIG. 5 further illustrating the construction of the tamper resistant cap.
Figure 9:
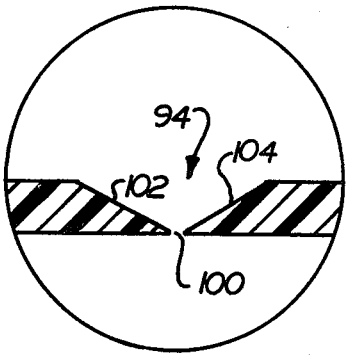
FIG. 9 is an enlarged fragmentary sectional view of an axial groove or section of reduced cross sectional area formed in the sidewall of the tamper resistant cap to promote breakage of the cap under the influence of forces tending to remove the cap from the plug.

The groove 94 has an open bottom or radially inner portion 100 (see FIG. 9) formed between sloping side surfaces 102 and 104 of the groove. The open portion 100 of the groove 94 extends from the circular end surface 98 of the base section 54 to the end wall 84 and is interrupted only by a retaining section 108 (see FIG. 5). The retaining section 108 extends between the two side surfaces 102 and 104 of the groove 94 to retard sidewise deflection of the base section 54. Similarly, the groove 96 has an open bottom portion 112 which extends between the circular surface 98 of the base 54 and an upper portion of the lock tab 66. The open bottom portion of the groove 96 is interrupted only by a retaining section 114 (FIGS. 5 and 6).

Upon the application of an upwardly directed force to the handle 90, the portion of the base section 54 to the left (as viewed in FIGS. 3, 5 and 6) of the grooves 94 and and 96 tends to pull outwardly away from the plug body 60. At the same time, the portion of the base section 54 disposed to the right (as viewed in FIGS. 3, 5 and 6) is pressed against the right side of the plug 46. The resulting tension stresses in the base section of the cap 42 cause the relatively weak connector portions 108 and 114 of the grooves 94 and 96 (see FIG. 5) to break.

Continued application of force to the handle 90 causes the end wall 84 to break with a resulting separation of the cap 42 into two sections, that is a section to which the handle 90 is connected and a section on the opposite side of the grooves 94 and 92. Of course, once the cap 42 has been broken in this manner, there is a clear indication that the cap has been removed from the plug 46 and that a socket may have been connected with the plug to effect removal of fluid from the container 20.

It is contemplated that attempts may be made to disengage the lock tabs 62–70 from the annular seal ring groove 74 without breaking the tamper resistant cap 42. Due to the presence of the axially extending grooves 94 and 96 in opposite sides of the cap, the sidewall 50 of the cap will be broken under the influence of even relatively small forces applied to the cap in an attempt to disengage it from the plug 46. In addition, access to outwardly extending side surfaces 120 and 122 (see FIG. 6) of the lock tabs 62–70 is blocked by sections 124, 126, 128, 130 and 132 (FIGS. 3, 5 and 6) which extend between the base section 54 and the end wall 84 of the cap 42.

The blocking sections 124-132 are integrally formed with the base section 54 and end wall 84. The blocking sections 124–132 have parallel axially extending side surfaces 136 (see FIG. 6). The blocking section side surfaces 136 extend parallel to and are disposed closely adjacent to the opposite side surfaces 120 and 122 of each of the lock tabs 62–70 to block access to the lock tabs 62–70. This prevents unauthorized engagement of the lock tabs in an effort to deflect them radially outwardly to a retracted condition in which they are disengaged from the annular seal ring groove 74. The blocking sections 124–132 perform the additional function of interconnecting the end wall 84 and the base section 54. It should be noted that the groove 94 is formed in the blocking section 132.

Figure 7:
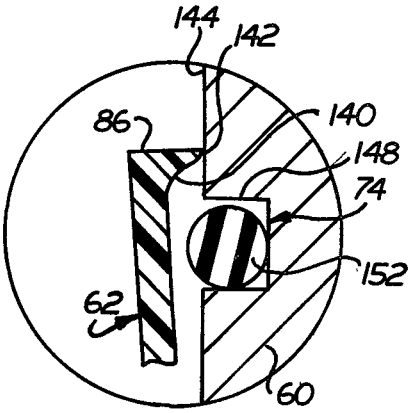
FIG. 7 is an enlarged fragmentary sectional view illustrating a lock tab in a deflected condition prior to engagement of the tab with the annular seal ring groove on the plug.

When the tamper resistant cap 42 is to be positioned on a plug 46, the cap is moved into axial alignment with the circular end face 78 of the plug and is moved downwardly toward the inner end portion 62 of the plug. As the cap moves downwardly, cam surfaces 140 (see FIG. 7) formed on each of the lock tabs 62–70 engages the outer end of the plug 46 and resiliently deflects the associated lock tab radially outwardly to the retracted position shown in FIG. 7. Continued downward movement of the cap results in sliding movement of nose end portions 142 of each of the lock tabs 62–70 along a cylindrical outer side surface 144 of an outer end portion of the plug body.

Figure 4:
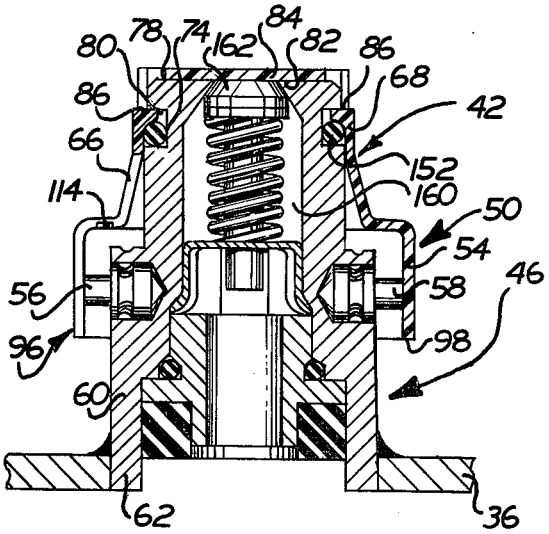
FIG. 4 is an elevational sectional view, taken generally along the line 4—4 of FIG. 3 and illustrating the manner in which lock tabs or sections on the tamper resistant cap engage an annular seal ring groove formed in the plug.
Figure 8:
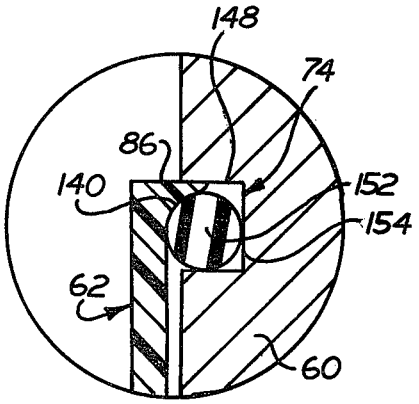
FIG. 8 is an enlarged fragmentary sectional view, generally similar to FIG. 7, illustrating the lock tab in a retaining or locking position in which it engages an upper side surface of the seal ring groove to hold the tamper resistant cap on the plug.

When the cap 42 has been moved to the position shown in FIG. 4, the lock surfaces 86 on the outer ends of the lock tabs 62–70 are just slightly past the annular upper side surface 148 of the seal ring groove 74. The natural resilience of each of the lock tabs 62–70 causes them to spring inwardly from the retracted position shown in FIG. 7 to the locking or engaged position shown in FIG. 8. In the engaged position, the locking surfaces 86 disposed on the outer end portions of the lock tabs 62–70 engage the side surface 148 of the annular groove 74 to hold the cap 42 in position on the plug 46.

The locking surfaces 86 on the tabs 62–70 extend parallel to the end wall 84 and the upper side surface 148 of the recess 74. This results in the locking surfaces 86 along being disposed in flat abutting engagement with the side surface 148 and the end wall 84 being disposed in flat abutting engagement with the end face 78 of the plug body when the tabs are in the engaged position shown in FIG. 8. In addition, when the lock tabs 62–70 are in the engaged position, the cam surfaces 140 on the lock tabs press an annular O-ring seal 152 against a cylindrical bottom surface 154 of the groove 74. When the cap 42 has been removed and a socket assembly is connected with the plug 46, the O-ring seal 152 sealingly engages a cylindrical inner surface of the socket assembly to prevent leakage of fluid between the plug and socket assembly.

Although many different types of plugs 46 could be utilized, the plug 46 includes a valve chamber 160 (see FIG. 4) in which a valve member 162 is disposed to block flow of fluid from the container. The valve 162 is opened by a valve in the socket of a quick-disconnect coupling when the socket is connected with the plug 46. The manner in which the valve 162 is opened when the socket and plug are connected is the same as described in U.S. Pat. No. 2,896,977 and will not be further described herein to avoid prolixity of description. It should be noted that when the tamper resistant cap 42 is engaged with the plug 46, the end wall 84 of of the cap covers most of the end face 76 of the plug to prevent exposure of the end face and the outer end of the valve 162 to contaminants in the atmosphere around the container.

The tamper resistant cap 42 is advantageously formed of plastic and is integrally molded as one piece. By forming the cap 42 with a one piece construction in which the base 54, handle 90, lock tabs 62–70, blocking sections 124-132, and end wall 84 are integrally formed, the construction of a relatively large number of the caps at a relatively low cost per cap is facilitated. In addition the forming the cap with a one piece construction makes tampering with the cap without breaking the sidewall at the grooves 94 and 96 more difficult.

Although the construction of only the cap 42 has been fully described herein, it should be understood that the cap 44 is of the same construction and cooperates with an associated plug in the same manner. Although both of the caps 42 and 44 could be manually positioned on their associated plugs, the construction of the caps is such that they are particularly well adapted for use in association with suitable machines which would automatically place the caps on the plugs.

It should be understood that although the cap 42 has been described herein in connection with a particular plug 46, it is contemplated that the cap could be utilized in association with other plugs. When plugs having a construction somewhat different from the construction of the plug 46 are utilized, the lock tabs 62–70 may engage a side surface on the plug other than the side surface 80 of the annular O-ring grooves 74. A separate annular groove could be provided in the inner or outer end portion of the plug for engagement by the lock tabs if desired. However, it is believed to be advantageous to utilize the lock tabs in association with the annular seal ring groove 74 since the necessity of forming a separate groove in the body of the plug is eliminated and since the lock tabs hold the seal ring 152 in the groove when the cap is disposed over the plug.

It is contemplated that certain individuals may attempt to remove the cap 42 from the plug 46 without breaking the cap. In attempting to do this, it is believed that they may try to pull each of the lock tabs 62–70, in turn, outwardly from the groove 74. As the lock tabs are individually pulled outwardly away from the groove, the cap could be tipped to engage the portion of the plug body disposed axially outwardly of the annular groove 74 with the outer end of the lock tabs. When each of the lock tabs has been removed outwardly and the position of the cap adjusted so that it is disposed in engagement with the plug body 60, the cap could be pulled axially off of the plug body without breaking the cap.

Figure 10:
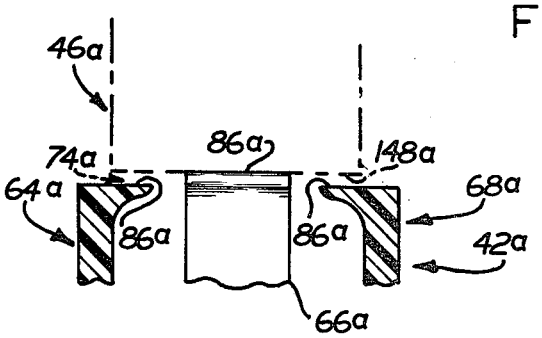
FIG. 10 is a schematic illustration of a second embodiment of the invention in which the lock tabs have different lengths.

In order to prevent this from happening, the cap can be constructed with lock tabs having different axial lengths. A cap having such a construction is illustrated schematically in FIG. 10. Since the embodiment of the invention illustrated in FIG. 10 is substantially the same as the embodiment of the invention illustrated in FIGS. 1 through 9, similar numerals will be utilized to designate similar components, the suffix letter "*a*" being added to the numeral associated with FIG. 10 to avoid confusion.

The lock tabs **64*a* and 68*a* of a tamper resistant cap 42*a* are formed with an axial length which is less than the axial length of the other lock tabs. This has been illustrated schematically in FIG. 10 in which the lock tabs 64*a* and 68*a* are shown with retaining surfaces 86*a* which are disposed in a spaced apart relationship relative to an upper side surface 148*a* of the annular groove 74*a*. The retaining surface 86*a* of the lock tab 66*a* is disposed in abutting engagement with the side surface 148*a* of the annular groove 74*a*. The remaining lock tabs, that is the tabs corresponding to the tabs 62 and 70 have the same length as the lock tab 66*a* and have retaining surfaces disposed in engagement with the side surface 148*a* of the groove 74*a***.

Due to the fact that the lock tabs have different axial lengths, it will be extremely difficult, if not impossible, to pull these lock tabs outwardly from the plug body one at a time while tipping the cap. Although the two tabs **64*a* and 68*a* have been shown as having the same relatively short length and the remaining tabs as having a length equal to the length of the tab 66*a*, it is contemplated that each of the tabs could be made a different length if desired. If this was done, the relatively short and relatively long tabs would be located relative to each other in such a manner that it would be impossible to tip the cap to remove the tabs one at a time from engagement with the annular groove 74***a*.

Figure 11:
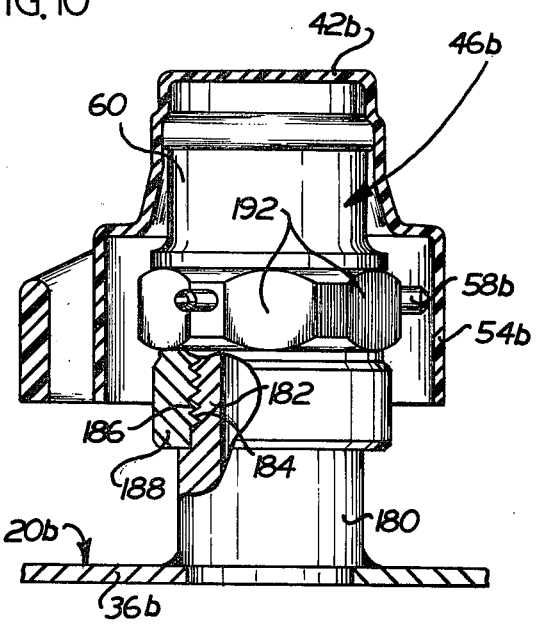
FIG. 11 is a fragmentary sectional view illustrating an embodiment of the invention in which a separate base is used to connect a quick-disconnect plug with a container.

In the embodiment of the invention illustrated in FIGS. 1 through 9 the plug body 60 is fixually connected with the end wall 36 of the container 20. It is believed that it may be preferred to fixually mount a boss or base on the end wall 36 of the container and to mount the plug body on the base. An embodiment of the invention having this construction is illustrated in FIG. 11. Since the components of the embodiment of the invention illustrated in FIG. 11 are substantially the same as the components of the embodiment of the invention illustrated in FIGS. 1 through 9, similar numerals have been utilized to designate similar components, the suffix letter "*b*" being utilized in association with the embodiment of the invention illustrated in FIG. 11 to avoid confusion.

A quick-disconnect coupling plug 46*b* is mounted on the end wall 36*b* of a container 20*b* by engagement with a boss or base 180. The base 180 is welded to the container end wall 36*b*. The base 180 has a cylindrical outer end portion 182 on which an external thread convolution 184 is formed. An internal thread convolution 186 on an end portion of a plug body 60*b* engages the external thread convolution 184 on the base 180. The base 180 has a cylindrical central passage which connects the plug 46*b* in fluid communication with the interior of the container 20*b*. The plug body 60*b* is advantageously provided with a plurality of wrenching flats or side surfaces 192 which are engaged by a wrench to tightly connect the plug 46*b* with the base 180.

In order to prevent disengagement of the plug 46*b* from the base 180, the wrenching flats 192 are completely enclosed by cylindrical base portion 54*b* of a tamper resistant cap 42*b*. Since the base 54*b* of the cap 42*b* extends downwardly past the wrenching flats 192, the wrenching flats 192 cannot be engaged to remove the plug 46*b* from the base 180 without breaking the cap.

In view of the foregoing description it is apparent that the present invention provides a tamper resistant cap 42 which is used in association with the plug 46 of a quick-disconnect coupling. The cap 42 cannot be removed from the plug 46 without breaking the cap. Once the cap 42 has been broken, there is a clear indication that a socket may have been connected with the plug 46.

The tamper resistant cap 42 is of a one-piece construction and has inwardly projecting lock tabs or sections 62–70 which engage an annular seal ring groove 74 on the plug 46 to hold the cap 42 in position. When the cap 46 is to be removed from the plug, the cap is broken along axially extending grooves 94, 96 formed in a sidewall of the cap. An end wall 84 is provided on the cap to cover the end of the plug.

Having described one specific preferred embodiment of the invention, the following is claimed:

1. An apparatus comprising a container to hold fluid, a plug assembly extending from a portion of said container, said plug assembly including a plug body having an inner end portion connected with said container, an outer end portion through which fluid flows to a socket assembly when said plug assembly is connected with the socket assembly, and an annular groove disposed between said inner and outer end portions of said plug body, said plug assembly further including an annular seal ring disposed in said groove to sealingly engage a socket assembly when the socket assembly is connected with said plug assembly, said apparatus further including indicating means connected with said plug assembly for providing an indication that a socket assembly has not been connected with said plug assembly after connection of said indicating means with said plug assembly, said indicating means including a base section circumscribing said plug body at a location disposed between said container and said annular groove in said plug body to block connection of a socket assembly with said plug assembly, locking means connected with said base section for engaging said annular groove to prevent disengagement of said indicating means from plug body without breaking said indicating means, said locking means including a plurality of spaced apart locking sections which extend outwardly from said base section into said annular groove in said plug body, an end section having surface means for at least partially covering said outer end portion of said plug body, and a plurality of spaced apart side sections disposed between said locking sections, at least one of said side sections having an outer end portion connected with said end section and an inner end portion connected with said base section.

2. An apparatus as set forth in claim 1 wherein said groove in said plug body has an annular axially outer side surface area, each of said locking sections including surface means for abuttingly engaging said outer side surface area of said groove to block outward movement of said base section relative to said plug body.

3. An apparatus as set forth in claim 2 wherein said surface means on said end section is spaced apart from said surface means on each of said locking sections by a distance which is at least as great as the distance between the outer side surface area of said groove and said outer end portion of said plug body.

4. An apparatus as set forth in claim 1 wherein said inner end portion of said plug assembly includes retainer means which is engaged by a socket assembly to hold the plug and socket assembly against relative movement when the plug and socket assemblies are interconnected, said retainer means being covered by said base section of said indicating means to prevent engagement of said retainer means by a socket assembly.

5. An apparatus as set forth in claim 1 wherein said base section includes a slot which extends at least part way across said base section to promote breakage of said base section upon application to said indicating means of forces tending to disengage said indicating means from said plug assembly.

6. An apparatus as set forth in claim 1 wherein a first one of said plurality of locking sections has a first length and a second one of said plurality of locking sections has a second length which is greater than said first length.

7. A one piece indicating member which is removable from a plug of a quick-disconnect coupling only by breaking said indicating member to provide a clear indication that a socket may have been connected with the plug, said indicating member including frangible wall means for telescopically receiving at least a portion of the plug and for preventing separation of said frangible wall means from the plug without breaking of said frangible wall means, said frangible wall means including a rigid base section which circumscribes the plug when said frangible wall means and plug are in a telescopic relationship, a plurality of spaced apart locking sections which are integrally formed with said rigid base section and which are resiliently deflectable relative to said rigid base section between a locking position projecting inwardly of the rigid base section and a retracted position, each of said locking sections including locking surface means for abuttingly engaging a side surface of the plug when said frangible wall means and plug are in a predetermined telescopic relationship and the locking section is in its locking position to prevent disengagement of said frangible wall means from the plug, each of said locking sections further including cam surface means for engaging the plug and resiliently deflecting the associated one of said locking sections outwardly from the locking position to the retracted position as said frangible wall means is moved toward the predetermined telescopic relationship with the plug, each of said locking sections being movable under the influence of its own natural resilience from the retracted position to the locking position upon movement of said frangible wall means into the predetermined telescopic relation with the plug, said frangible wall means further including at least one portion of a reduced cross sectional area which extends at least part way across said rigid base section to promote breakage of said frangible wall means upon the application to said frangible wall means of forces tending to disengage said frangible wall means from the plug when said locking sections are in their locking positions.

8. An indicating member as set forth in claim 7 wherein said frangible wall means further includes a plurality of spaced apart blocking sections which are integrally formed with said rigid base section and are interspersed with said locking sections to block access to side portions of said locking sections when said locking sections are in their locking positions.

9. An indicating member as set forth in claim 8 wherein said relatively weak portion of reduced cross sectional area extends into one of said blocking sections.

10. An indicating member as set forth in claim 8 further including end wall means connected with said blocking sections and having an inner surface for at least partially covering an outer end portion of the plug to prevent exposure of the end portion of the plug to foreign particles.

11. An indicating member as set forth in claim 7 wherein said relatively weak portion of a reduced cross sectional area extends into one of said locking sections.

12. An indicating member as set forth in claim 7 further including handle means integrally formed with said frangible wall means for use in applying force to said frangible wall means to break said frangible wall means and disengage said indicating member from the plug.

13. An indicating member as set forth in claim 7 further including end wall means connected with said frangible wall means for at least partially covering an outer end face of the plug to prevent exposure of the end face of the plug to foreign particles.

14. An indicating member as set forth in claim 13 wherein each of said locking surface means is spaced apart from and extends generally parallel to said end wall means.

15. An indicating member as set forth in claim 13 wherein each of said locking surface means is spaced apart from said end wall means by a distance which is substantially the same as the distance between the end face of the plug and the side surface of the plug to enable said locking surface means to engage the side surface of the plug when said locking sections are in their locking positions and said end wall means is in engagement the end face of the plug.

16. An indicating member as set forth in claim 15 wherein said frangible wall means includes a plurality of spaced apart side sections extending between said rigid base section and said end wall means, each of said side sections being disposed between a pair of said locking sections.

17. An indicating member as set forth in claim 7 wherein at least one of said locking sections has a length which is less than the length of another of said locking sections.

18. An apparatus comprising a container to hold fluid, a plug body connected with the container, said plug body including an end face and an annular groove disposed on the plug body between the end face and container, and indicating means connected with said plug body for providing a clear indication that a socket has not been connected with said plug body since connection of said indicating means with said plug body and for at least partially covering the end face of said plug body, said indicating means including an end wall overlying the end face of said plug body, a circular sidewall integrally formed with said end wall and circumscribing said plug body at a location between said end face and said container, said circular sidewall including a plurality of narrow sections of reduced cross sectional area which extend axially along the circular sidewall, locking means integrally formed with said circular sidewall and engaging said annular groove for holding said indicating means on said plug body, and handle means integrally formed with said circular sidewall and disposed between a pair of said sections of reduced cross sectional area for applying force to break said circular sidewall at said sections of reduced cross sectional area to disengage said indicating means from said plug body.

19. An apparatus as set forth in claim 18 wherein said locking means includes cam surface means for resiliently deflecting said locking means radially outwardly as said indicating means is positioned on said plug body and for allowing said locking means to move radially inwardly into engagement with the annular groove when said end wall is in abutting engagement with the end face of said plug body.

20. An apparatus as set forth in claim 19 wherein said locking means includes locking surface means for engaging a side surface of said annular groove on the plug body, said locking surfaces means being spaced from an inner surface of said end wall by a distance which is at least as great as the distance from the end face of said plug body to the side surface of said annular groove.

21. An apparatus as set forth in claim 18 wherein said narrow sections of reduced cross sectional area include longitudinally extending openings formed in said circular sidewall.

22. An apparatus as set forth in claim 18 further including retaining surface means fixedly connected with said plug body for engaging a socket to hold the plug body and socket against relative movement, said retaining surface means being covered by said circular sidewall of said indicating means to prevent engagement of said retaining surface means by a socket.

23. An apparatus as set forth in claim 18 wherein said locking means includes a plurality of locking sections which have free end portions disposed adjacent to said end wall, each of the end portions of said locking sections having a stop surface which is adapted to abuttingly engage a side wall of said annular groove, at least one of said stop surfaces being disposed further from said end wall then another of said stop surfaces.

24. An apparatus as set forth in claim 18 further including a base fixedly connected with said container, said base having threaded outer end portion, said plug body having a threaded end portion disposed in engagement with said threaded outer end portion of said base, said plug body having a plurality of side surface areas adapted to be engaged by a wrench to rotate said plug body relative to said base, said circular side wall of said indicating means circumscribing said side surface areas of said plug body to block access to said side surface areas with a wrench.

* * * * *